US005893194A

United States Patent [19]

Karmel

[11] Patent Number: 5,893,194

[45] Date of Patent: Apr. 13, 1999

[54] VACUUM SYSTEM

[76] Inventor: Israel Karmel, P.O. Box 488, Garibaldi Highlands, British Columbia, Canada, V0N 1T0

[21] Appl. No.: 08/664,339

[22] Filed: Jun. 14, 1996

[30] Foreign Application Priority Data

Jun. 28, 1995 [CA] Canada ..... 2152858

[51] Int. Cl.[6] ..... A47L 5/38

[52] U.S. Cl. ..... 15/314; 15/301; 15/422.2

[58] Field of Search ..... 15/301, 314, 422.2

[56] References Cited

U.S. PATENT DOCUMENTS

| | | | |
|---|---|---|---|
| 1,048,477 | 12/1912 | Allington | 15/301 X |
| 2,270,579 | 1/1942 | Chamberlin et al. | 15/322 X |
| 2,979,755 | 4/1961 | McCaskill | 15/314 |
| 3,240,000 | 3/1966 | Hayes et al. | 15/422.2 X |
| 4,580,309 | 4/1986 | Ogden | 15/422.2 |
| 5,095,578 | 3/1992 | Wade | 15/422.2 X |
| 5,311,640 | 5/1994 | Holland | 15/422.2 X |

FOREIGN PATENT DOCUMENTS

| | | | |
|---|---|---|---|
| 53-84368 | 7/1978 | Japan | 15/314 |

*Primary Examiner*—Chris K. Moore

*Attorney, Agent, or Firm*—Fulwider Patton Lee & Utecht, LLP

[57] ABSTRACT

A vacuum system for a building, in particular, a building with multiple dwellings. There is a fan to develop suction mounted in a compartment having a dust inlet and a dust outlet. A motor drives the fan. The motor has a drive shaft to extend into the fan compartment. There is a dust collection head communicating with the inlet. A dust disposal pipe connected to the outlet extends to a remote dust receptacle. There is a vent for the dust receptacle to prevent dust being fed back into the atmosphere. The system can operate satisfactorily without a filter. It draws dust in from a point between the source of the dust and the dust receptacle so that suction is not applied through the contents of the dust receptacle.

5 Claims, 4 Drawing Sheets

VACUUM SYSTEM

FIELD OF THE INVENTION

This invention relates to a vacuum system for a building. The invention finds particular application in multiple-unit buildings such as town houses, condominiums and office buildings.

DESCRIPTION OF THE PRIOR ART

The traditional vacuum cleaner comprises a motor to drive a fan to develop suction. Typically the motor is also used to drive a rotating brush by a belt drive from a drive shaft of the motor. The vacuum cleaner is moved across a surface. The brush agitates the dust, which is drawn upwardly by the fan, into a filter bag that is an integral part of the vacuum cleaner.

Central vacuum systems have become increasingly popular. They comprise a head mounted on a hose. The hose plugs into a valve in a wall which is connected to a source of vacuum. Typically the source of vacuum is located in the basement and is a relatively large cylinder including a filter and a motor to generate the vacuum. There are valves mounted in a number of locations in a building; piping extends from those valves to the cylinder. The insertion of the hose into the valve communicates the head with the source of vacuum. It is common to have a low voltage connection built into the valves so that the unit can be operated simply by inserting a hose into the valve, which simultaneously makes the connection to apply current to the motor.

The prior art vacuum cleaners have the disadvantage that the filter bag cannot be perfect so that dust is inevitably fed back into the atmosphere of the room being cleaned. Central vacuum systems are relatively expensive. The filters, located in the cylinder, can become blocked relatively easily. The filter is remotely mounted and there is a tendency not to inspect and clean it. Furthermore, these systems also can feed dust back into the atmosphere through imperfect operation of the filter.

The cylinder has openings in it, usually louvres, to allow evacuation of air on the downstream side of the fan. Thus any dust carried by the air after the filter passes out through the louvres, into the atmosphere of the building.

The installation of the motor in the cylinder means that the cylinder, with the filter chamber, motor and fan, is quite an expensive item. Furthermore, the systems are relatively inflexible. It can be difficult and inconvenient to reposition the cylinder once it has been installed.

Fire alarm systems are known. Typically they sense the presence of smoke, for example by the smoke interfering with a beam of light passing between two points. This operates a switch in a circuit that includes a strident alarm. A main concern with fire is smoke inhalation. Few victims of fire die through burning. They die mainly from inhalation of smoke and toxic gases, the latter produced by combustion.

SUMMARY OF THE INVENTION

The present invention provides a system that is effective both as a dust collection system and as a smoke expulsion system.

As a dust collection system the invention seeks to provide a greatly simplified system that, in particular, has a number of options for location of the motor and fan and does not need a filter to operate satisfactorily in multiple unit buildings. With the present invention emptying dust from the system is a simple matter. In single buildings an outside or garage receptacle for dust may be emptied at intervals. In a multiple unit building all the units can send dust to one dust collector or receptacle which is emptied by a janitor As a smoke expelling system the invention is effective in expelling smoke from a building, allowing the occupants greater time to escape.

Accordingly, in its broadest aspect, the present invention is a vacuum system for a building comprising a fan to develop suction and mounted in a compartment having a suction inlet and an ejection outlet; a motor to drive said fan, said motor having a drive shaft to extend into said fan compartment; an ejection disposal pipe connected to said outlet to extend to a remote location, preferably external to the building.

In a further aspect the invention is a vacuum system for a building comprising a fan to develop suction and mounted in a compartment having a dust suction inlet and a dust ejection outlet; a motor to drive said fan, said motor having a drive shaft to extend into said fan compartment; a dust collection head communicating with said inlet; a dust ejection disposal pipe connected to said outlet to extend to a remote dust receptacle; and a vent for said dust receptacle.

Desirably the motor and the fan are within one integral casing called a vacuum ejector unit in this specification, that also defines the compartment for the fan. In this arrangement the drive shaft of the motor extends through an imperforate, air-tight partition between the motor compartment and the fan compartment ensuring that dust cannot reach the motor, which is another disadvantage of many prior art systems.

The vacuum ejector unit may also be part of the head that is used to sweep the floor. It can also be mounted on the wall of a building, in the wall or behind the wall, under the floor, in a closet or it can also be on the dust receptacle. The vacuum ejector unit is inexpensive and light in weight. Although the motor is able to generate considerable vacuum, it is quite a simple matter to put a plurality of motors in series, to provide a boost suction should that be necessary. The motors may be together or apart.

The system includes a flap valve to prevent feedback of dust, if desired.

BRIEF DESCRIPTION OF THE DRAWINGS

The invention is illustrated in the drawings in which.

DESCRIPTION OF THE PREFERRED EMBODIMENTS

Figure 1:
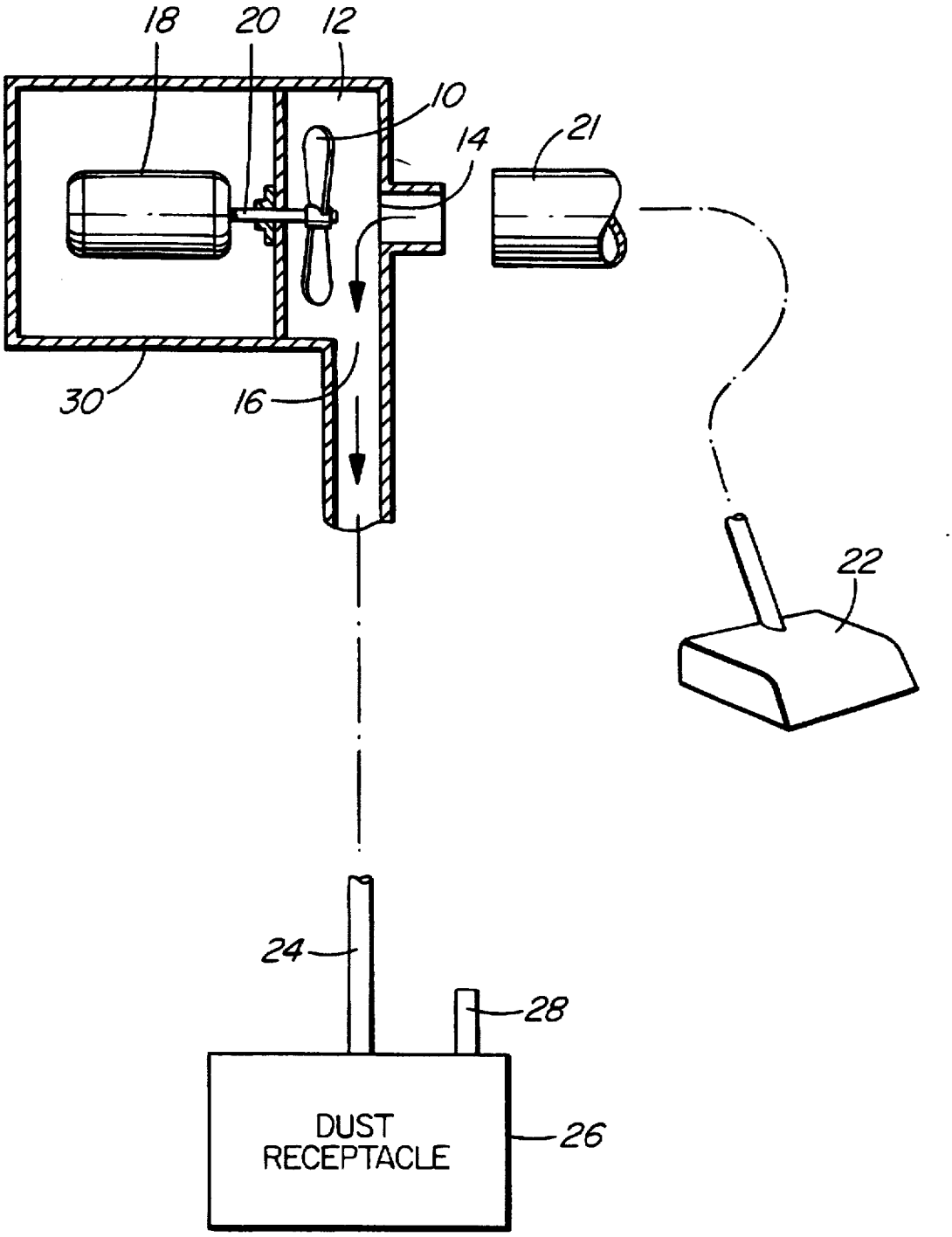
FIG. 1 is a general view of an apparatus according to the present invention.
Figure 2:
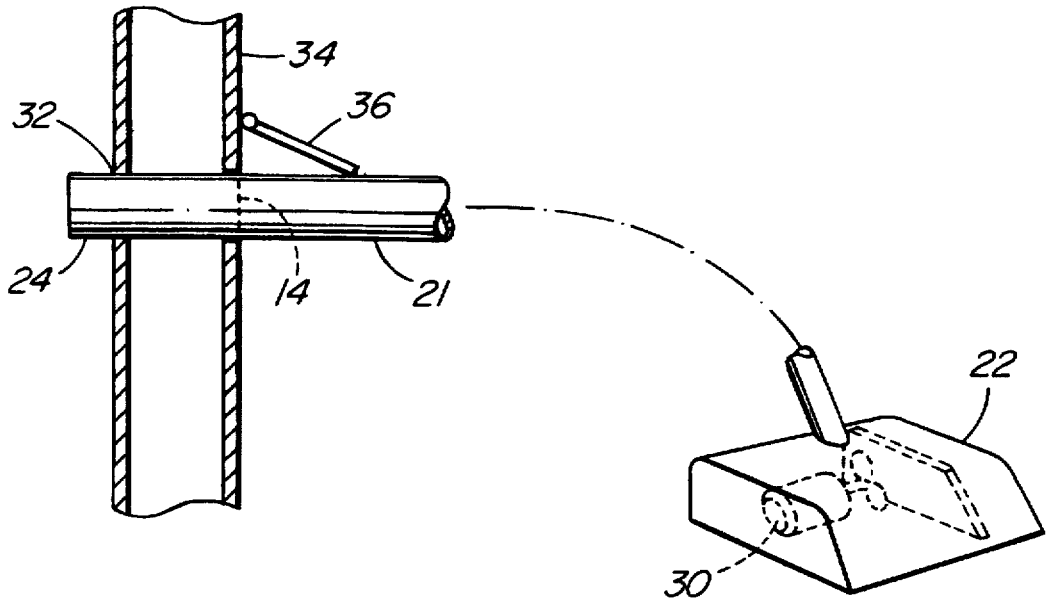
FIG. 2 is a detail of equipment shown in FIG. 1.
Figure 3:
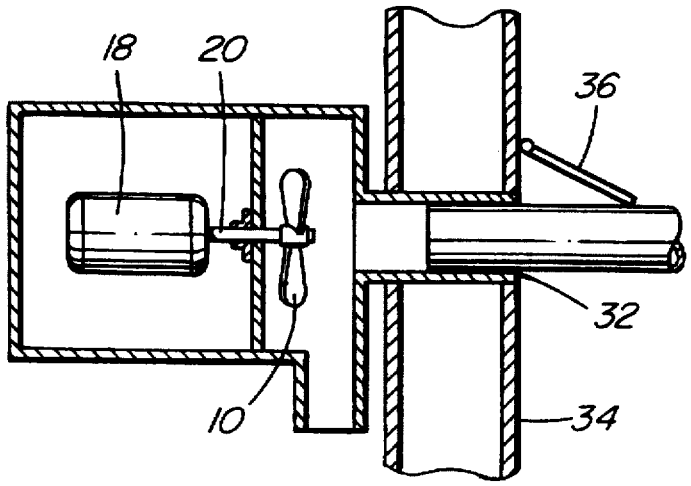
FIG. 3 is a further detail indicating a different position of the motor.

FIGS. 1 to 3 show a vacuum system for a building. There is a fan 10 to develop suction mounted in a compartment 12 having a dust inlet 14 and a dust outlet 16. A motor 18 drives the fan. The motor 18 has a drive shaft 20 to extend into the fan compartment 12 and the fan 10 is mounted on the drive shaft 20. There is hose 21 having a dust collection head 22 on one end. Head 22 usually has a wand and the usual vacuum attachments including a brush. The brush may also be belt or air driven. These components are well known in the art.

There is a dust disposal pipe 24 connected to the outlet 16 that extends to a dust receptacle 26 at a remote location. For example, it may be in the basement of a building or in a garage. There need be no filter in the system. The dust receptacle 26 is provided with a vent pipe 28 that may be greatly elongated to ensure that dust does not escape to the inside atmosphere. For example, such a vent could feed outside the building, for example on the roof. A simple filter may be attached to the end of the vent pipe 28 and the entrance to the vent at the dust receptacle 26.

Figure 4:
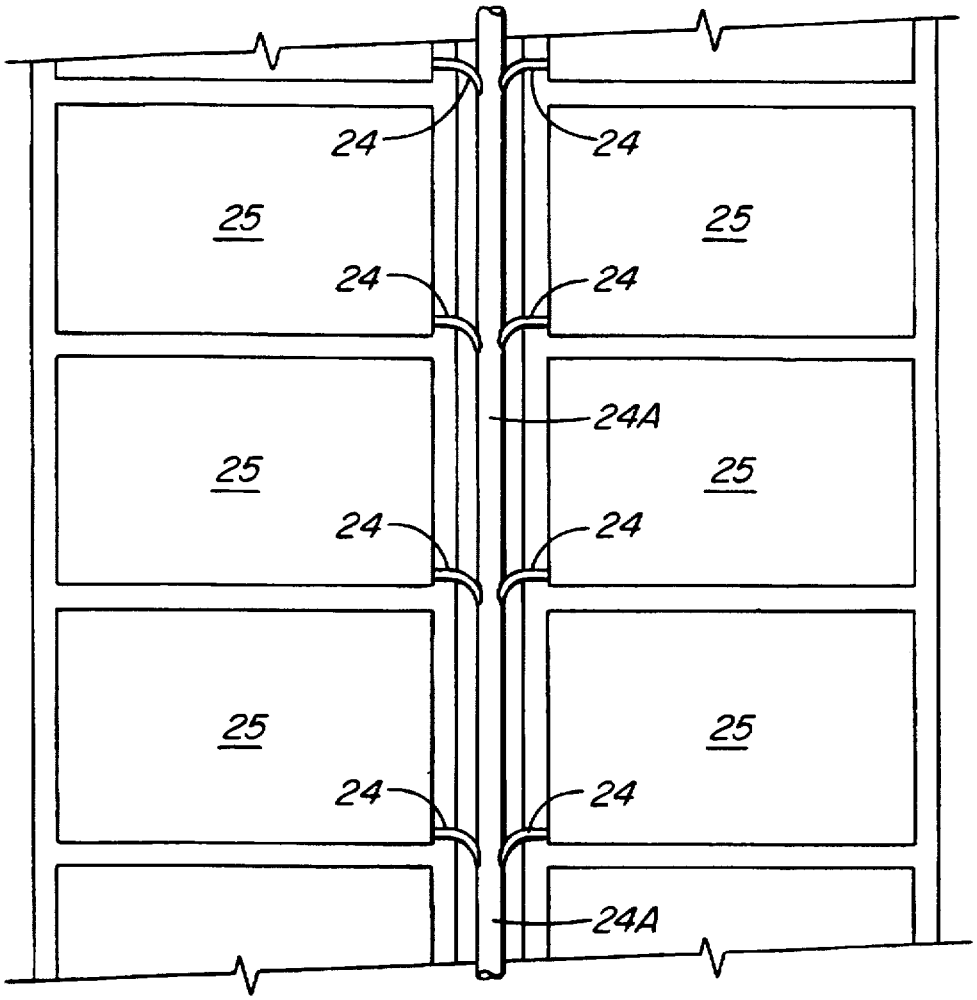
FIG. 4 illustrates schematically use of the invention in a multiple unit building.

As shown in FIG. 1, the motor 18 and fan 10 are within one vacuum ejector unit 30. The inlets and the outlets 14 and 16 are part of unit 30. As an economy, the outlet pipe 24 may trace the outlet pipe of, for example, a dryer unit used in many North American buildings. Particularly in multiple unit buildings it is possible to have the pipe 24 receive dust from a number of units. FIG. 4 shows schematically a plurality of disposal pipes 24 in units 25 communicating with a main outlet 24A. Main outlet 24A may be attached to, or actually be, an existing effluent outlet in the building, for example for dryers.

FIG. 2 illustrates one position in which the vacuum ejector unit 30 may be placed. In the embodiment of FIG. 2 unit 30 is mounted in the head 22 of the apparatus. The outlet pipe 21 extends through an opening 32 in a wall, protected by a spring flap 36. As in prior art central vacuum systems it is probable that the outlet pipe will engage low voltage contacts mounted to permanently installed pipe 24 behind the wall 34 to activate the motor 18. By this means insertion of the pipe 21 into the opening 32 in the wall 34 switches on the system.

FIG. 3 illustrates the mounting of a vacuum ejector unit 30 behind a wall. Again the pipe 21 enters the opening 32.

Figure 5:
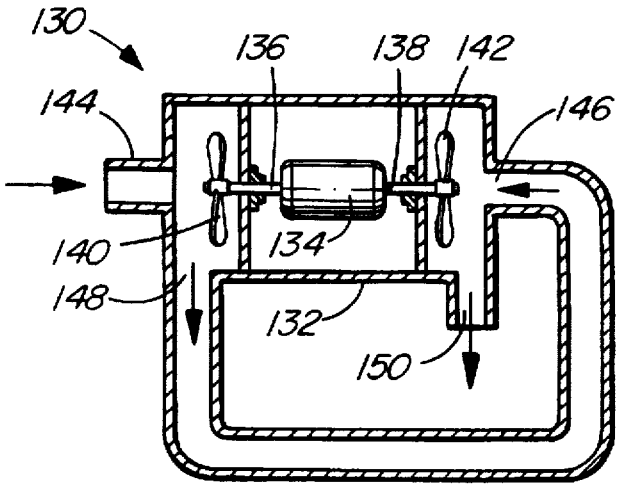
FIG. 5 shows an alterative vacuum ejector unit useful in the present invention which generates increased suction.

FIG. 5 illustrates a preferred vacuum ejector unit 130 useful in the apparatus of the present invention. It comprises a housing 132 with a motor 134 located in the housing 132. There are opposed drive shafts 136 and 138 extending from the motor 134. There are fans 140 and 142 on drive shafts 136 and 138 respectively. Each fan has a pitch different from the other fan so that the fans force air in the same direction as they are, of course, driven by the same motor 134.

There is an inlet 144 and 146 and an outlet 148 and 150 for each fan. The outlet 148 of the first fan 140 communicates with the inlet 146 of the second fan 142. Thus air is drawn into the inlet 144 of the first fan 140, as shown by the arrows, through the outlet 148 of the first fan 140, to the inlet 146 of the second fan 142, to the second fan 142 and from outlet 150 into pipe 24 to the dust receptacle 26.

In a particularly preferred embodiment, there are means to vary the angle of the inlet 146 of the second fan 142 to assist in driving the fan 142 by pressure of air from the first fan 140.

Using this embodiment of FIG. 5 it has been found that suction can be improved substantially without requiring further electrical power.

Figure 6:
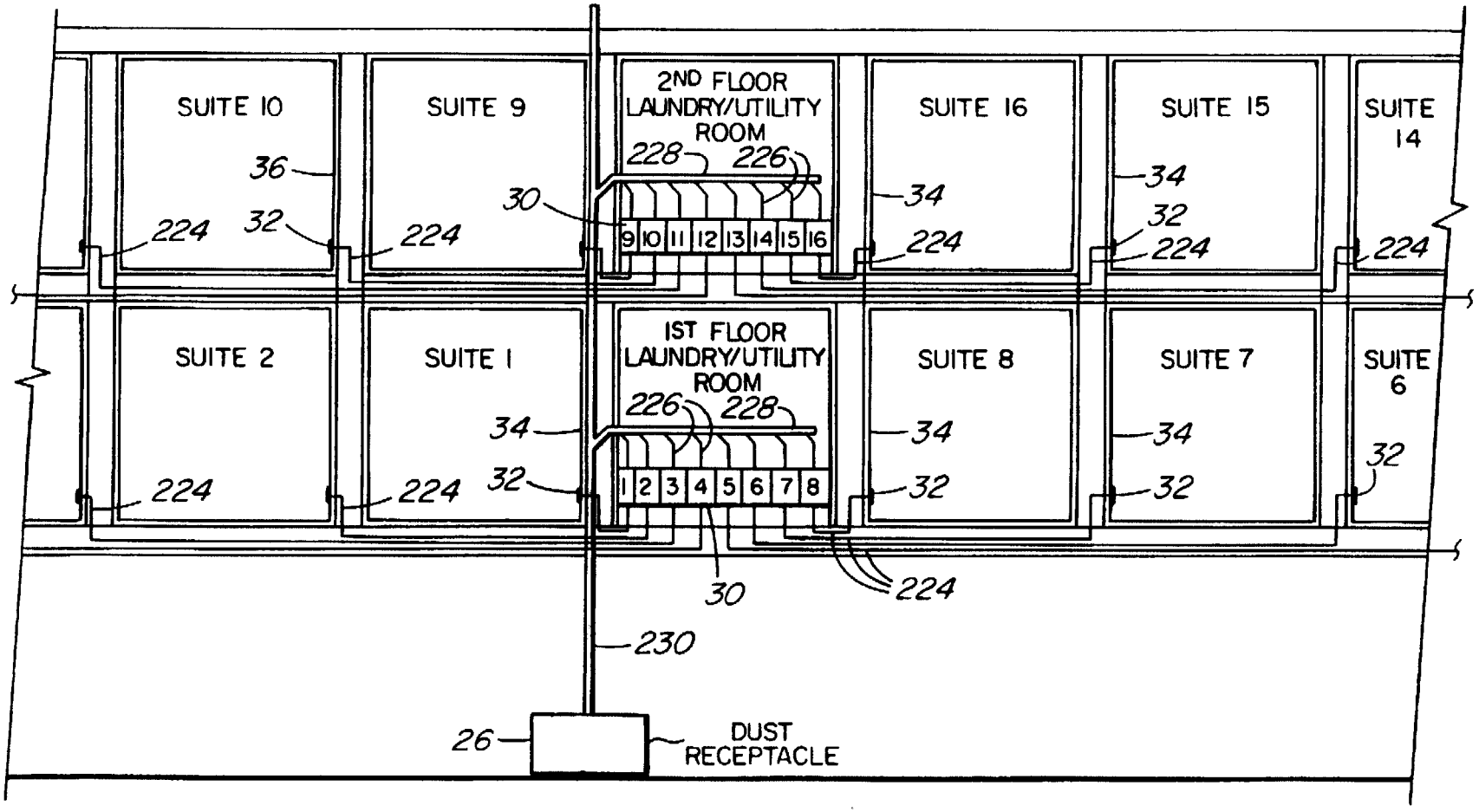
FIG. 6 is a schematic view similar to FIG. 4 but more detailed.

FIG. 6 is schematic view of an apartment building equipped with vacuum systems according to the present invention. Each suite, identified by a number as it might be in an apartment building, has an opening 32 in a wall 34. First dust disposal pipes 224 lead to an injector unit 30, one for each unit and each identified in FIG. 6 with a number corresponding to the suite number to which it is joined by a disposal pipe 224. Dust is ejected from a unit 30 to a second dust disposal pipe 226, to a first collector pipe 228 to a main collector pipe 230 to the dust receptacle 26.

Thus FIG. 6 shows the use of units 30 remote from the suites they are used to clean.

The present invention has a number of advantages over the prior art. It is possible to have one hose 21 for one apartment with just one opening 32. This means the multiplicity of valves typical with prior art central vacuums systems is avoided.

The motors 18 and 134, which are the same unit, are relatively cheap to produce. It is easy to arrange the motors in series, should additional suction be necessary.

The vacuum ejector unit 30 can be anywhere. It can be in the apartment, or on the head 22, all as shown in the drawings. It can even be on the dust receptacle.

If necessary, to facilitate cleaning, the head 22 can be equipped with a roller or brush. Air turbine actuated brushes can be used.

The system may not need belts. It is completely sealed so that there is no dust returned to a room. Furthermore, the receptacle 26 can be of simple structure and of large volume. Individual emptying is not required in multiple buildings.

There is no filter to block. It is sufficient to vent the dust receptacle 26 to atmosphere to ensure continuous operation of the device. The vent pipe 28 should, desirably, be of considerable length to avoid dust being fed to the atmosphere. A filter may be placed on the outside end of the vent pipe 28 and/or at the beginning of the pipe.

The vacuum ejector unit 30 is quite compact but powerful. A low amp motor is perfectly adequate.

The vacuum ejection units 30 for the apartments 25 in a multiple apartment building require only one centralized filter and dust collection system, regardless of the number of apartments 25 although a plurality of dust disposal pipes may be required if there are a large number of apartments on one floor. The simple vacuum ejection units 30 may be located in each apartment but there is a centralized collection of the dust which may then be emptied by a janitor. The tenants of the building never need to empty the dust or worry about a filter and the apartments are free of dust. In contrast, portable vacuum cleaners exhaust into the room as the air passes through the filter bag and, inevitably, carries dust with it.

The invention permits the use of many existing venting systems for effluent are already present in a building. The outlet pipe 24 may be attached to these units, may be fed through the units or may even make use of the pipes themselves. That is to say, the outlets 16 or 150 of the vacuum ejector unit 30 or 130 may be attached to an existing dryer unit which may then double as dust ejection pipes.

The vacuum ejector units 30 have proved powerful and effective. They have proved able to drive dust laden air forcefully into a dust receptacle over considerable distances. However, it should be noted that, in fact, they only need drive the dust laden air to pipe 24. Once the dust laden air has been forced through outlet 16, it can then fall by gravity. Unlike a central vacuum system where the motor and fan are mounted in the basement and relies on suction to draw dust into the receptacle and continues to apply suction through dust already drawn into the filter in the receptacle, the vacuum ejection unit of the present invention pushes the dust laden air into the dust receptacle. It does not suck it into the receptacle because it need not be mounted in the dust receptacle. This also means that a filter is not necessary or sucked on in the system at all.

The vacuum ejector units are simple to service and replace. They are light in weight and can easily be moved.

One can eliminate one outlet in the system where several outlets are necessary with prior art systems. This generally depends on the floor area involved.

In the smoke expulsion aspect the dust collector head and the remote dust receptacle are not required, although the latter may remain.

The system may include a connection to a smoke alarm. When the alarm senses smoke it sounds an alarm and also switches on the fan, using the same switch that operates the alarm, if necessary.

In general the smoke expulsion system will have its own inlets and not rely on the dust collection system inlets which are usually closed when not in use by a spring loaded door. In these circumstances the smoke inlets may be closed by a flap valve when the dust collection system is in use. A typical arrangement would have a simple solenoid that operates to close a flap over the smoke inlet when the dust collection system is switched on. As a simple alternative the dust collection head pipe can simply act as a closure for the smoke exhaust pipe when it is inserted into the wall inlet.

Inlets for the dust collection system would generally be high but need not be. They can be positioned wherever there is a need.

The smoke expulsion aspect of the invention is considered, like the dust collection aspect, have the great advantage of expelling or pushing the air. That is to say the material is only sucked for a short distance and is then pushed the rest of the way to the outlet.

If the container of the dust system is used then either the smoke may be fed straight into the dust receptacle or it may be diverted, again by the use of solenoid operated valve which may be a simple flap valve.

The dust collection system and the smoke expulsion system may be the same system. Alternatively a house or other buildings may be built with just a dust collection system or just a smoke extraction system. It is also considered desirable to have a relay to activate the system when the alarm goes.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. A vacuum ejection unit comprising:

a housing defining a motor compartment and a pair of opposed fan compartments, each fan compartment being separated from the motor compartment by an air tight partition;

a motor located in the motor compartment;

opposed drive shafts extending from said motor into the fan compartments;

a first fan mounted on one drive shaft in the first fan compartment and a second fan mounted on the other drive shaft in the second fan compartment;

an inlet and an outlet in each fan compartment;

the first fan having an opposite pitch from the second fan and the outlet of the first fan compartment communicating with the inlet of the second fan compartment such that the fans co-operate to draw air into the inlet of the first fan compartment, through the outlet of said first fan compartment, to the inlet of the second fan compartment and from the outlet of the second fan compartment.

2. A vacuum system for a building comprising:

a housing defining a motor compartment and a pair of opposed fan compartments, each fan compartment being separated from the motor compartment by an air tight partition;

a motor located in the motor compartment;

opposed drive shafts extending from said motor into the fan compartments;

a first fan mounted on one drive shaft in the first fan compartment and a second fan mounted on the other drive shaft in the second fan compartment;

a dust inlet and a dust outlet in the housing;

a dust collection head communicating with said dust inlet;

an inlet and an outlet in each fan compartment;

the dust inlet of the housing communicating with the inlet of the first fan compartment, and the dust outlet of the housing communicating with the outlet of the second fan compartment;

the first fan having an opposite pitch from the second fan and the outlet of the first fan compartment communicating with the inlet of the second fan compartment such that the fans co-operate to draw air, together with any dust present therein, via the dust inlet into the inlet of the first fan compartment, through the outlet of said first fan compartment, to the inlet of the second fan compartment and from the outlet of the second fan compartment to the dust outlet of the housing;

a dust disposal pipe connected to said dust outlet to extend to a remote dust receptacle; and a vent for said dust receptacle.

3. A vacuum system for a building comprising:

a vacuum ejector unit comprising a housing having a fan compartment and a motor compartment separated by an air tight partition, a fan to develop suction mounted in the fan compartment, the fan compartment having a dust inlet and a dust outlet, and a motor mounted in the motor compartment to drive said fan, said motor having a drive shaft to extend into said fan compartment through said partition;

a dust collection head in which the vacuum ejector unit is incorporated to receive dust under suction at the inlet of the vacuum ejector unit;

a dust disposal pipe connected to said outlet of the vacuum ejector unit for carrying dust under positive pressure;

a remote dust receptacle connected to said dust disposal pipe; and a vent for said dust receptacle.

4. A system as claimed in claim 3 in which the building includes multiple building units having at least one common dust disposal pipe for a plurality of building units.

5. A vacuum system for a building having multiple building units comprising:

a plurality of vacuum ejector units positioned at at least one location in the building remote from each of the building units, each vacuum ejector unit comprising a housing having a fan compartment and a motor compartment separated by an air tight partition, a fan to develop suction mounted in the fan compartment, the fan compartment having a dust inlet and a dust outlet, and a motor mounted in the motor compartment to drive said fan, said motor having a drive shaft to extend into said fan compartment through said partition, a dust collection head at each building unit communicating with the inlet of one of said plurality of vacuum ejector units to receive dust under suction;

a dust disposal pipe connected to each of the outlets of said plurality of vacuum ejector units for carrying dust under positive pressure to a common dust receptacle; and a vent for said dust receptacle.

* * * * *

UNITED STATES PATENT AND TRADEMARK OFFICE

CERTIFICATE OF CORRECTION

PATENT NO. : 5,893,194

DATED : Apr. 13, 1999

INVENTOR(S) : Israel Karmel

It is certified that error appears in the above-identified patent and that said Letters Patent is hereby corrected as shown below:

Column 3, line 38, change "pipe", to read --hose--.

Signed and Sealed this

Fifth Day of September, 2000

*Attest:*

*Attesting Officer*

Q. TODD DICKINSON

*Director of Patents and Trademarks*